US007178804B1

(12) United States Patent
Traylor

(10) Patent No.: US 7,178,804 B1
(45) Date of Patent: Feb. 20, 2007

(54) COLLAPSIBLE CHESS GAME PIECES

(76) Inventor: Frank Traylor, 4233 Jenny Lake Trail, Keller, TX (US) 76248

( * ) Notice: Subject to any disclaimer, the term of this patent is extended or adjusted under 35 U.S.C. 154(b) by 0 days.

(21) Appl. No.: 11/031,707

(22) Filed: Jan. 10, 2005

(51) Int. Cl.
*A63F 3/00* (2006.01)

(52) U.S. Cl. ..... 273/288; D21/388

(58) Field of Classification Search ..... 273/288, 273/290; 446/387, 388, 487; D21/388
See application file for complete search history.

(56) References Cited

U.S. PATENT DOCUMENTS

| | | | | | |
|---|---|---|---|---|---|
| 550,048 | A | * | 11/1895 | Ketchum | 211/166 |
| 1,472,520 | A | * | 10/1923 | Grimm | 428/9 |
| 1,600,813 | A | * | 9/1926 | Flentye | 428/19 |
| 2,916,843 | A | * | 12/1959 | Meyer | 428/8 |
| 3,040,459 | A | * | 6/1962 | Marcy | 40/124.4 |
| 3,483,742 | A | * | 12/1969 | Murray | 40/124.4 |
| 3,759,523 | A | | 9/1973 | Randolph | |
| 3,789,526 | A | * | 2/1974 | Lavinson | 40/124 |
| 3,797,149 | A | * | 3/1974 | Morrison | 40/124.2 |
| 3,806,128 | A | | 4/1974 | Endfield | |
| 4,315,376 | A | * | 2/1982 | Eichenauer | 40/124.4 |
| D277,015 | S | | 1/1985 | Elliott | |
| 5,895,046 | A | | 4/1999 | Lee | |
| 5,911,328 | A | * | 6/1999 | Shampo | 211/40 |
| 6,062,242 | A | * | 5/2000 | Lin | 135/31 |
| 6,513,809 | B1 | | 2/2003 | Graff | |

* cited by examiner

*Primary Examiner*—Vishu Mendiratta
(74) *Attorney, Agent, or Firm*—Harpman & Harpman

(57) ABSTRACT

This invention is directed to chess pieces for playing chess, more specifically to large three dimensional game pieces that are associated with outdoor game playing surfaces in which oversize game pieces are physically moved about a board representation that the player actually walks on. Each of the game pieces has a plurality of radially positioned interconnected panel elements which are removably secured to a support base and are collapsible upon one another after use for storage and transportation.

8 Claims, 6 Drawing Sheets

COLLAPSIBLE CHESS GAME PIECES

BACKGROUND OF THE INVENTION

1. Field of the Invention

This device relates to oversized lawn/patio game pieces such as chessmen that are formed from multiple flat panels and wire like frames which are arranged to emulate a free standing three dimensional oversized chess game pieces.

2. Description of Prior Art

Prior art devices of this type have been developed in a variety of different structural configurations; see for example U.S. Pat. Nos. 3,759,523, 3,806,128, 5,895,046, 6,513,809 and D277,015.

In U.S. Pat. No. 3,759,523, chess game pieces are disclosed having a spool like construction in which individual game piece designation for identification is indicated by indicia on the top spool surface.

U.S. Pat. No. 3,806,128 shows a game piece for a chess set in which the pieces are registerably interlinked with one another in top to bottom orientation in a tubular storage and transportation configuration.

U.S. Pat. No. 5,895,046 claims a sectional chessman for playing chess in which each piece is made from a composite of two dimensional elements comprising a base, an upstanding universal body section and a distinctive piece identification head section that is selectively fitted into the free upper edge of the universal body section.

U.S. Pat. No. 6,513,809 illustrates chess pieces and chess sets formed of hardware components such as nuts and bolts. A threaded bolt extends vertically from a base with a plurality of correspondingly sized apertured beads placed thereon and secured by a threaded nut and locking hardware fastening elements to designate different game pieces.

Design Pat. No. D277,015 discloses an ornamental design for a set of stackable chess pieces in which conical shaped pieces are stacked or nested one on top of the other for storage purposes.

SUMMARY OF THE INVENTION

An enlarged collapsible three dimensional chess game pieces which are used in playing the game of chess are formed from a plurality of pre-positioned interconnected two dimensional panel elements. Each game piece has distinctively shaped repetitive panels that are radially arranged and extend from an annular shaped support base. The panel elements are interconnected to one another for support and collapsible storage together. Alternately, the panels are defined by elongated wire-like framing with an attached flexible exterior fabric covering that overlies the assembled frame elements defining a solid three dimensional surface representation of the configured game piece.

DETAILED DESCRIPTION OF THE INVENTION

Figure 1:
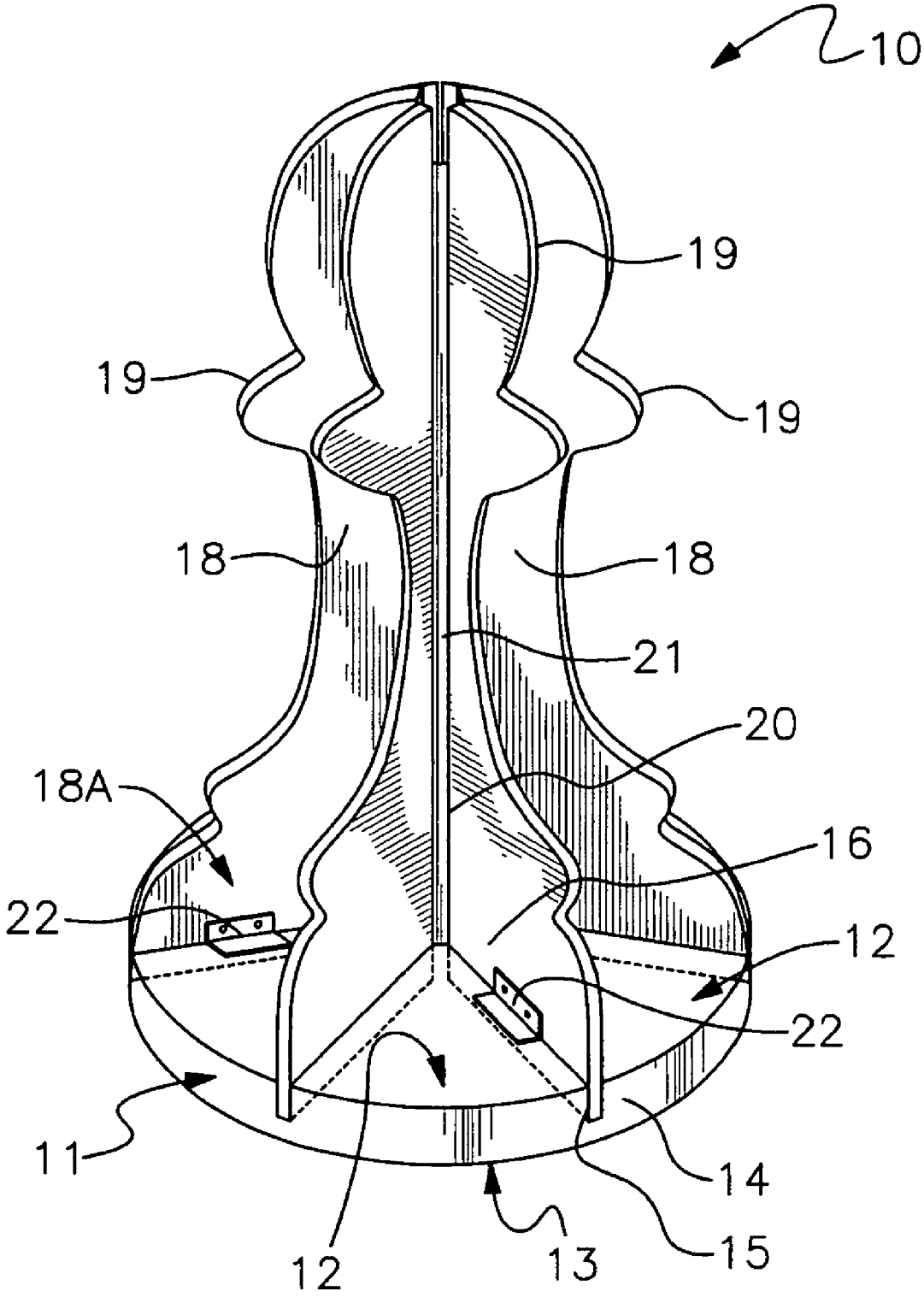
FIG. 1 is a perspective view of a multiple panel formed game piece.
Figure 2:
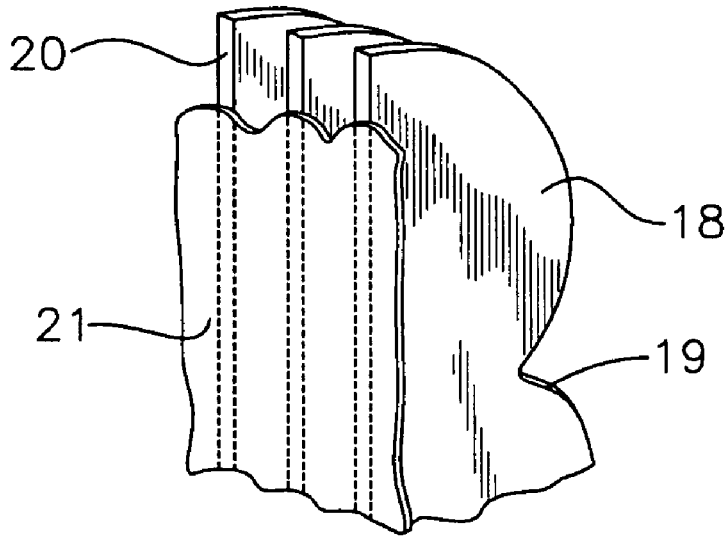
FIG. 2 is an enlarged perspective view of a portion thereof.
Figure 3:
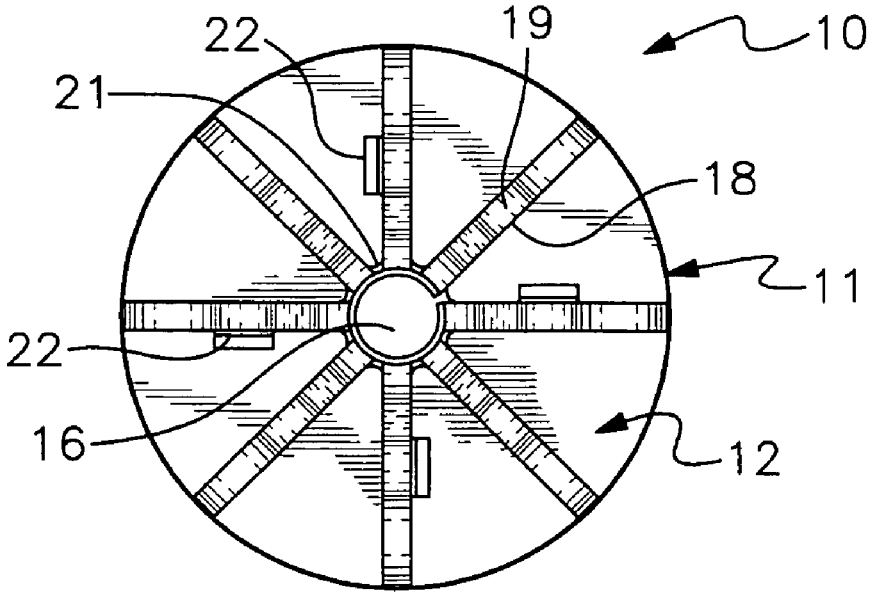
FIG. 3 is a top plan view thereof.
Figure 4:
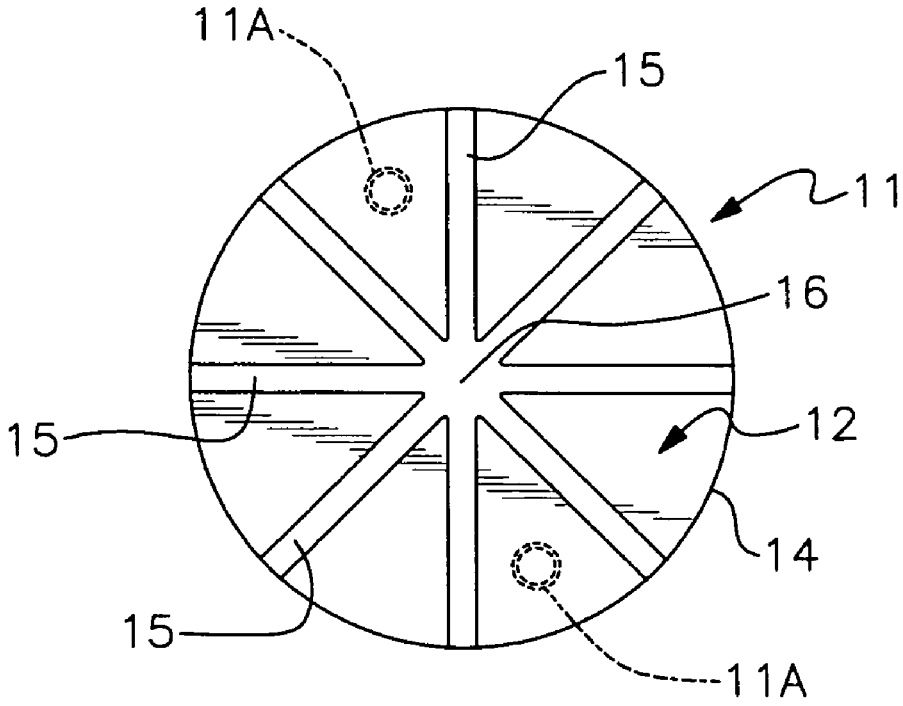
FIG. 4 is a top plan view of the support base.

Referring to FIGS. 1–6 of the drawings, a large scale collapsible game piece 10 can be seen having an annular support base 11 with a top engagement surface 12 and oppositely disposed bottom 13 and interconnected annular sidewall 14. The top surface 12 has a plurality of transsectional mounting radially spaced grooves 15 therein. The grooves 15 define a central recessed area 16. A plurality of identical flat panels 18 having a contoured distinctive edge 19 are secured together along their respective oppositely disposed edges 20 by a flexible sheet member 21, best seen in FIG. 3 of the drawings which allows for aligned storage engagement as will be described in greater detail hereinafter.

The interconnected multiple panels 18 are registerably aligned in upstanding relationship co-frictionally engaged within the corresponding support grooves 15 and additionally supported therein by multiple brackets 22 engaged between the top surface 12 of the base 11 and some of the adjacent panels side surface portions 18A. It will be seen that the multiple contoured edges 19 form a specific three dimensional chess game piece representation such as illustrated in FIG. 1 as a pawn.

The chess game pieces 10 of the invention so assembled are of an oversize scale appropriate for use in outdoor venues in which large game board playing surface representations (not shown) are scaled up to actually be walked on by the player (also not shown). Such large scale game board representations require the player to be able to physically walk up to and move the large scale game piece 10 of the invention around the appropriate designated board playing surface representation as will be well known and understood by those familiar with playing chess.

Figure 5:
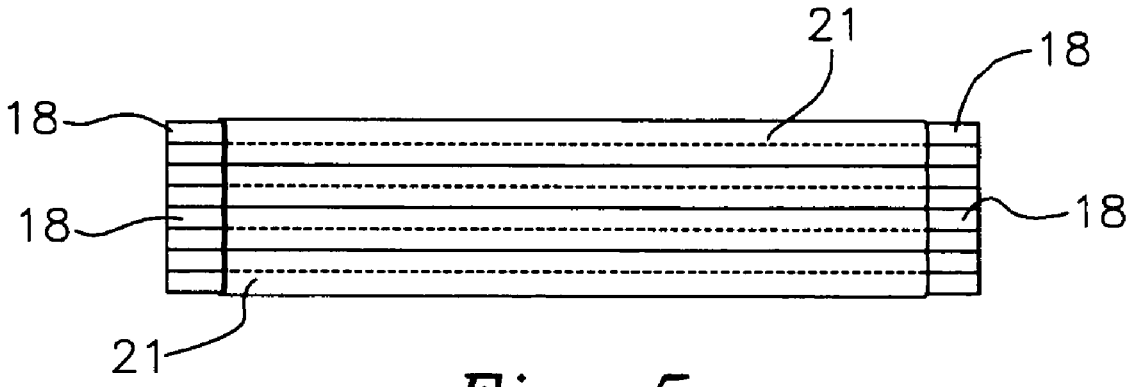
FIG. 5 is a side elevational view of a collapsed panelized game piece removed from its support base for storage and transportation.

Referring now to FIG. 5 of the drawings, the multiple interconnected flat panels 18 are shown removed from the base 11 and stacked in abutting aligned registration to one another for ease of transportation and efficient storage.

The support base 11 is preferably of a hollow construction of molded synthetic resin material and filled optionally with a weight providing material such as water or sand (not shown) through associated access ports and closure assemblies 11A therein.

Figure 6:
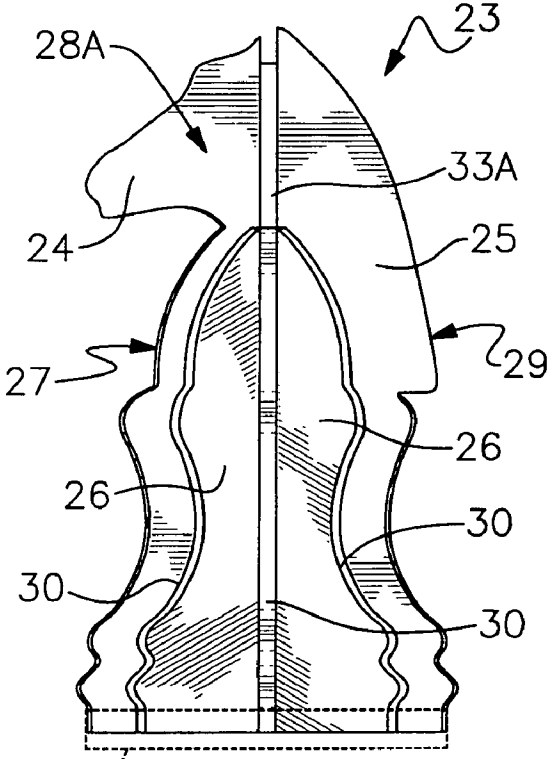
FIG. 6 is a side elevational view of an alternate panel construction of a distinctive chess game piece.
Figure 9:
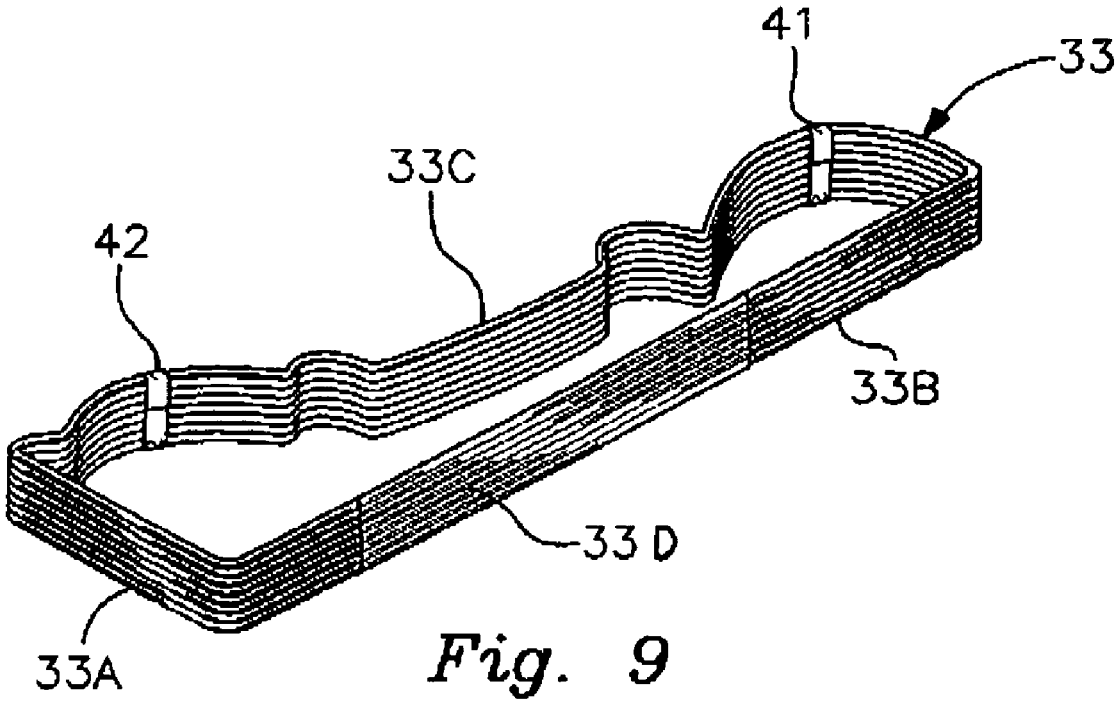
FIG. 9 is a perspective view of a collapsed stack wire frame elements for storage and transportation.

Referring now to FIG. 6 of the drawings, a first alternate form of the invention can be seen as a game piece 23 in which a specific chess game piece such as the "knight" is illustrated. The first alternate game piece 23 utilizes the support base 11 shown in broken lines as hereinbefore described with modified panels 24, 25 and 26. The panels 24 and 25 are of equal full size game piece height in which the panel 24 in this illustration has a contoured edge 27 of a distinctive horse head at 28A. The distinctive panel 25 correspondingly forms the other half of the "knight" game piece representation silhouette with a distinctive contoured edge 29 and are in planar alignment with one another.

The remaining identical panels 26 are of a reduced height with a distinctive contoured edge 30 and extend radially on the base 11 so as to complete the three dimensional game piece representation. All of the aforedescribed panels 24, 25 and 26 are interconnected to one another by a flexible sheet member 31 for ease of set up, alignment and collapsibility for storage off the base 11.

Figure 8:
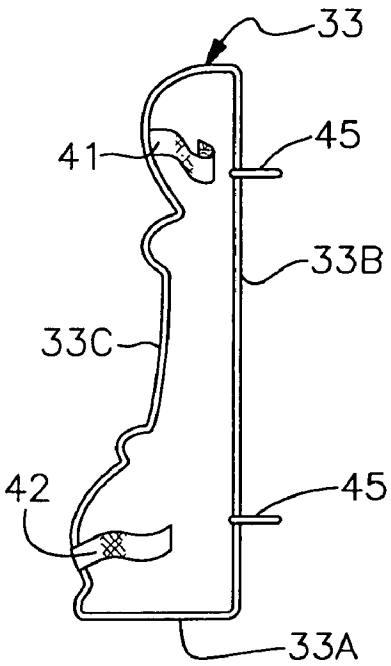
FIG. 8 is a side elevational view of the wire support frame thereof.

Referring now to FIGS. 7–11 of the drawings, a second alternative form of the invention can be seen wherein a chessman game piece 32 is formed from a plurality of interconnected independent frame elements 33, best seen in FIG. 8 of the drawings. The frame elements 33 can be of a wire rod construction or other elongated rod formed material, such as molded synthetic resin material and are configured with a straight base portion 33A, a right angular extending straight bock portion 33B and a contoured front portion 33C interconnecting therebetween and formed so as to define the game piece representation in this example a chess piece representation of a "pawn". The frame elements are interconnected to one another by a flexible sheet element 33D interengaging the back portions 33. Multiple identical frame elements 33 are arranged in an evenly spaced radial pattern on a modified support base 34 having multiple frame engagement clips 35 mounted thereon, as best seen in FIGS. 15, 16 and 17 of the drawings.

The support base 34 is hollow in the preferred embodiment and con be filled with a weight inducing material such as sand S or water (not shown) through aperture ports 34E.

Figure 7:
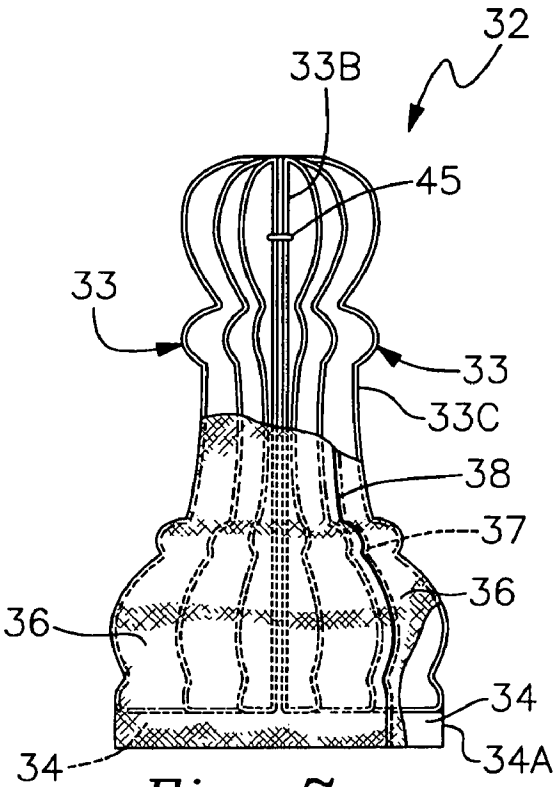
FIG. 7 is a front elevational view with portions broken away of a second alternate game piece construction utilizes multiple wire frame like elements with a cover thereover.
Figure 11:
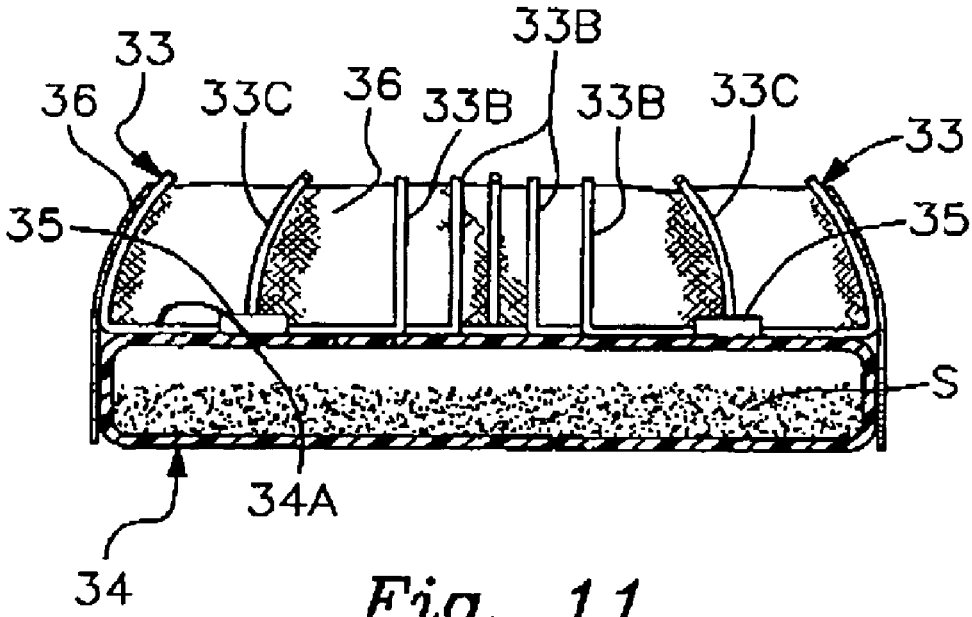
FIG. 11 is an enlarged cross-sectional view on lines 11—11 of FIG. 10.
Figure 10:
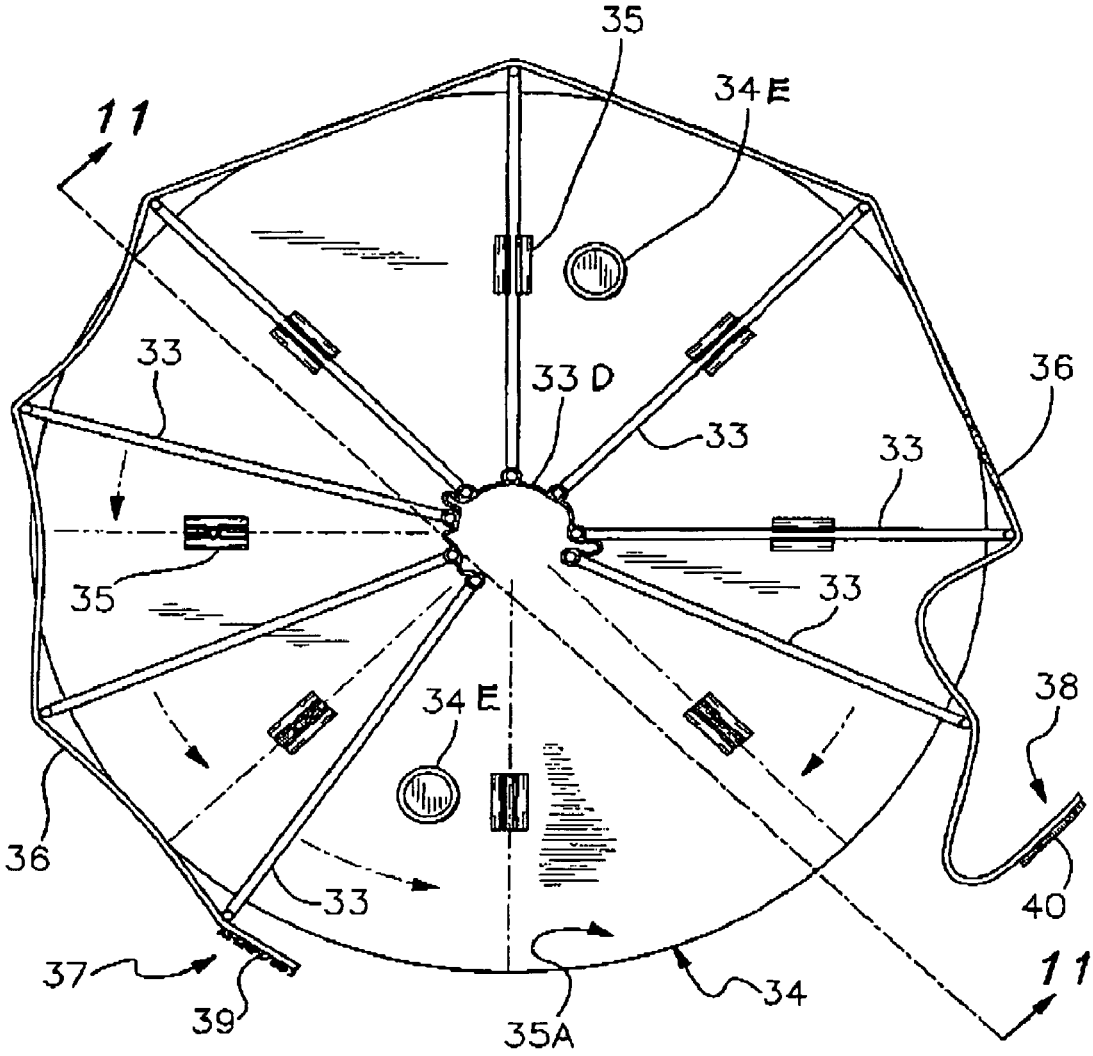
FIG. 10 is an enlarged illustrative partial top graphic view of a partially assembled wire support frame with a flexible exterior attached cover representation portions of which are broken away on a support base with frame engagement clips extending therefrom.

FIGS. 7, 10 and 11 of the drawings show an integral full fabric frame cover 36 can be seen which is selectively attached to the frame elements 33 which when fully opened will extend around the outside surfaces of the multiple frame elements 33 defining a solid representation of the particular game piece shape defined thereby. Respective elongated cover end edges 37 and 38 have corresponding selectively engageable hook and loop fastener strips 39 and 40 thereon known commercially as Velcro brand thereon which are engageable with one another so as to complete a true three dimensional contoured cover surface of the game piece.

It will be evident to one skilled in the art that a variety of different chess game pieces can be so formed by utilization of different select frame elements, size and contoured edge configuration and appropriately matching cover configurations.

Additionally, storage strops 41 and 42 may be provided that will hold the collapsible multiple frame elements 33 and attached frame cover 36 together for transportation and storage once removed from the base as graphically illustrated in FIG. 18 of the drawings. The frame cover 36 extends beyond the base portion 34A of the respective frame elements 33 and will therefore cover the support base 34 when in open deployed use position as seen in FIG. 11 of the drawings. The engagement clips 35 are removably secured to registration fittings in the upper surface 35A of the base 34 and can be removed with the base 34 inverted and used as a secondary game piece in certain game applications, such as checkers.

A pair of resilient strapping elements 45 may be used to help stabilize the multiple frame elements 33 by selectively securing assembled adjacent frame portions 33B towards one another as generally illustrated in FIG. 8 of the drawings.

It will thus be seen that a new and novel large scale collapsible chess game pieces have been illustrated and described and it will be apparent to those skilled in the art that various changes and modifications may be made therein without departing from the spirit of the invention.

Therefore I claim:

1. An enlarged collapsible chess game piece comprising, a plurality of upstanding wire frame elements having a contoured front portion defining and integral oppositely disposed straight back portion and a right angled straight base portion and a cover support surface, a weighted support base on which said multiple frames are radially positioned thereon, a fabric cover selectively secured and interconnected to said frame elements over on said contoured front portion defining said cover support surface of said respective frame elements, said frame elements interconnected to one another by a flexible element interengaging each of said straight edge back portions means for selectively securing said multiple frame elements to said support base, means for securing said cover about the contoured front portions of said pre-positioned frames on said support base, and means for stabilization of said support base.

2. The enlarged collapsible chess game piece set forth in claim 1 wherein said fabric cover extends beyond said multiple frame elements to overlie a portion of said support base.

3. The enlarged collapsible chess game piece set forth in claim 1 wherein said multiple frames are of an identical contoured delineation collapsible on one another for lightweight, practical transportation and storage.

4. The enlarged collapsible chess game piece set forth in claim 1 wherein said means for selectively securing said multiple frame elements to the surface of said support base comprises, a multiplicity of resilient clips on said support base.

5. The enlarged collapsible chess game piece set forth in claim 1 wherein said means for securing said cover on said pre-positioned frames on said base comprises, a plurality of attachment fittings engageable on each of said contoured frame portions and an inter-engageable fastener strips on respective longitudinally extending abutting free edges of said cover when fully deployed about said frame.

6. The enlarged collapsible chess game piece set forth in claim 1 wherein said frame elements are of an elongated continuous rod like configuration.

7. The enlarged collapsible chess game piece set forth in claim 6 wherein said frame elements are preferably made of synthetic resin material.

8. The enlarged collapsible chess game piece set forth in claim 1 wherein said frame elements are interconnected to one another by a flexible sheet element.

* * * * *